US005476344A

United States Patent [19]

Nordvall

[11] Patent Number: 5,476,344

[45] Date of Patent: Dec. 19, 1995

[54] INJECTION MEANS

[75] Inventor: Knut Nordvall, Norsborg, Sweden

[73] Assignee: Sundsvalls Manchetten AB, Stöde, Sweden

[21] Appl. No.: 142,286

[22] PCT Filed: May 24, 1991

[86] PCT No.: PCT/SE91/00369

§ 371 Date: Nov. 19, 1993

§ 102(e) Date: Nov. 19, 1993

[87] PCT Pub. No.: WO92/20901

PCT Pub. Date: Nov. 26, 1992

[51] Int. Cl.[6] ..... E02D 3/00; E21D 11/10

[52] U.S. Cl. ..... 405/269; 405/303; 405/150.1

[58] Field of Search ..... 405/233, 259.5, 405/263, 266, 267, 269, 303, 150.1; 52/744

[56] References Cited

U.S. PATENT DOCUMENTS

| | | | |
|---|---|---|---|
| 2,960,831 | 11/1960 | Lonaberger et al. | 405/263 |
| 3,260,053 | 7/1966 | Miller | 405/266 X |
| 4,362,440 | 12/1982 | Glaesmann et al. | 405/269 |
| 4,461,600 | 7/1984 | Norkus et al. | 405/269 X |
| 4,710,063 | 12/1987 | Faktus et al. | 405/269 |

FOREIGN PATENT DOCUMENTS

| | | |
|---|---|---|
| 413929 | 6/1980 | Sweden . |
| 445755 | 7/1986 | Sweden . |
| 9001491 | 10/1991 | Sweden . |
| 2102860 | 2/1983 | United Kingdom . |

*Primary Examiner*—David H. Corbin
*Attorney, Agent, or Firm*—Shapiro and Shapiro

[57] ABSTRACT

A device for injecting concrete, plastic or the like into cracks in a concrete structure, a rock face or the like comprises an elastic, radially expandable and substantially tubular body adapted to be securely and sealingly engaged within a bore hole in communication with the cracks. The body has a first end portion with a non-return valve to be introduced deepest into the bore hole and a second end portion adapted to be connected to a feed pipe for the material to be injected. The elastic body is formed as an integral unit and is adapted to expand into engagement with the bore hole before the non-return valve opens at a predetermined pressure to inject the material into the bore hole.

9 Claims, 1 Drawing Sheet

INJECTION MEANS

Figure 1:
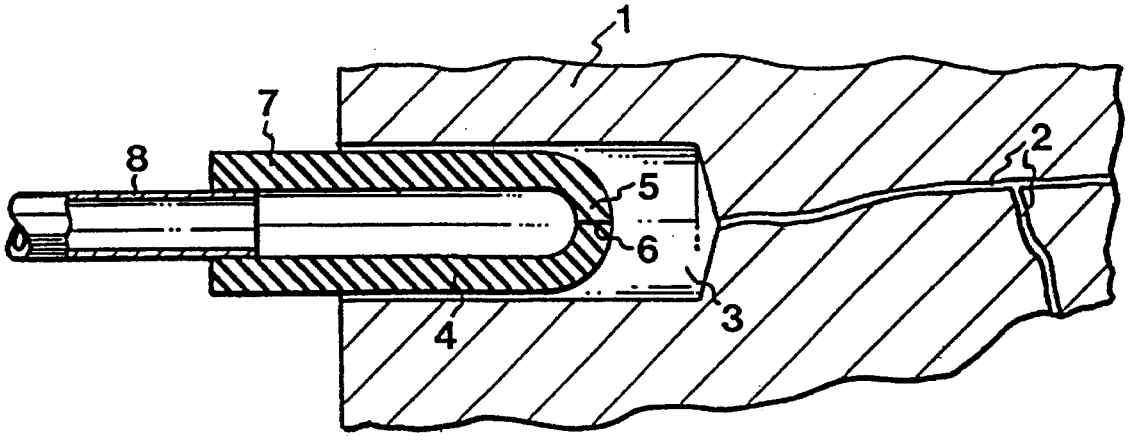

The present invention concerns a means for injecting concrete, plastic or the like into cracks in a concrete structure, a rock face end the like. The injection means comprises an elastic, radially expandable and substantially tubular body adapted to be securely and sealingly engaged with a bore hole for the cracks; a first end portion with a non-return valve means to be introduced deepest into the bore hole; and a second end portion adapted to be connected to a feeding pipe for the compound to be injected.

SE Printed Application 413,929 and GB-A-2,102,860 disclose injection means of the above features. These means are fixed in bore holes by means of key joints, the displacement of the first end portion with the non-return valve means towards the second end portion in relation to the tubular body causing the latter to expand into engagement with the bore hole, owing to the keying action between said body and the first end portion. Thus, the gripping power of the injection means is totally unrelated to the pressure of the injection compound. Further, these prior art means comprise several separate details which have to be assembled before use, for which reason these means are both complicated end expensive to manufacture. Owing to their construction and function, the injection means take time to handle, since they first must be anchored in the holes by the application of a pulling force on a detail thereof, and it is only after this operation that the compound can be injected. Also, it cannot be guaranteed that the gripping power of the prior art means is sufficient to keep said means in place in the holes when the compound is injected into the holes and the cracks under high pressure.

One object of the present invention is to provide an injection means which is securely held in place when the compound is injected.

Another object of the invention is to provide an injection means which is made in one piece and has no moving parts except in the non-return valve.

Yet another object of the invention is to provide a means which is not only simple and inexpensive to manufacture, but also uncomplicated, time-saving and reliable in operation.

A further object of the invention is to provide a disposable injection means enabling the feeding pipe with associated end portion to be easily separated from the remainder of the injection means when injection has been completed.

According to the invention, these objects are achieved by an injection means of the above type, which is characterised in that the elastic body, the first end portion and the second end portion are formed as an integrated unit, and that the elastic body is adapted to expand into engagement with the bore hole before the non-return valve means at a given pressure opens to inject said compound into the hole.

Further developments of the invention are apparent from the distinctive features recited in the appended claims.

The injection means according to the invention will be described in more detail below in connection with the injection of liquid injection compound, such as epoxy plastic, cement grout with or without swelling agent, polyurethane and the like, into cracks in concrete structures or rock faces to seal these cracks. The injection means may, however, also be used when an upper concrete has detached itself from a concrete slab, to fill the void. Further, the injection means can be used for contact injection to prevent vibrations between different elements, such as concrete beds and machine parts, the cavities therebetween being filled with epoxy plastic or cement.

Figure 2:
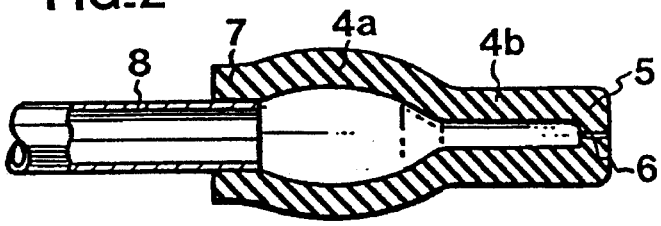
Figure 3:
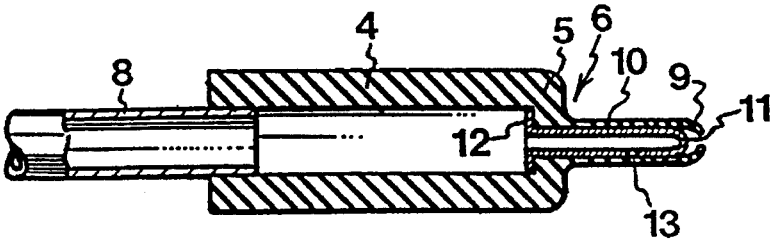
Figure 4:
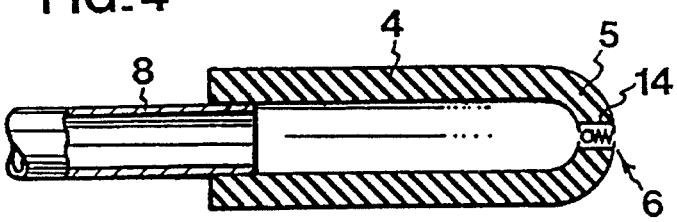

By way of examples, preferred embodiments of the invention will now described in more detail, reference being had to the accompanying drawing, in which FIG. 1 is a longitudinal section of the inventive injection means which has been introduced in a bore hole in a concrete structure with cracks to seal the structure, FIG. 2 is a longitudinal section of an alternative embodiment of the injection means especially suited for injecting a plastic composition, FIG. 3 is a longitudinal section of another alternative embodiment of the injection means having an integrated "bicycle valve", and FIG. 4 is a longitudinal section of yet another embodiment of the injection means having an integrated ball valve.

FIG. 1 shows a concrete structure, a rock face or the like 1 having cracks 2 which are to be sealed. A hole 3 has in known manner been drilled in the concrete structure 1 near to the crack 2 to enable insertion of the entire or the major part of the injection means into the concrete structure or the like. The diameter of the hole 3 is, of course, adapted to the outer diameter of the injection means to facilitate insertion.

The injection means consists of an elastic and substantially tubular body 4 which is radially expandable in order to be securely and sealingly engaged with the bore hole 3, a first end portion 5 with a non-return valve means 6 intended to be introduced deepest into the bore hole 3, and a second end portion 7 intended to be connected to a feeding pipe 8 for the injection compound. The elastic body 4, the first end portion 5 and the second end portion 7 are formed as an integrated unit, i.e. they are fixedly and unreleasably joined to one another. If desired, they can be made of different materials, but are, in the embodiment shown, of one and the same material.

In this embodiment, the non-return valve means 6 is in the form of one or more through slits, cross slots, holes or the like formed in the elastic end wall of the first end portion 5. The elastic body 4 is adapted to expand to engagement with the bore hole 3 before the non-return valve means 6 at a given pressure of the injection compound opens to inject the compound into the bore hole 3 and the cracks 2. Owing to the clamping function of the injection means in the bore hole, the compound can be injected as well as set and harden under pressure, the injection means being securely anchored in the bore hole. This clamping function is suitably controlled by the wall thickness of the elastic body 4, the number and design of the slits, and/or the selection of a suitable material.

At one end, the feeding pipe 8 is connected to a pressure fluid source (not shown) with injection compound, and at the other end it is connected to the second end portion 7 of the injection means. The feeding pipe is attached to the end portion by some adhesive, vulcanisation or the like. If desired,-the feeding pipe may naturally be fixed by means of clamp joints and the like.

The wall of the elastic body 4 is preferably made of a suitable rubber-like material, and may, when need be, have a reinforcement oriented in the longitudinal direction of said body, or any other type of reinforcement not hindering the radial expansion of said body. In some applications of the invention, the wall may suitably be made of a material with closed, gas-filled cells which may expand to serve as a seal against the bore hole 3 if the pressure of the injection compound should sink at the time of injection, e.g. because of a leak.

FIG. 2 shows an alternative embodiment of the injection means especially suited for injecting a plastic composition. The main difference between this embodiment and that of FIG. 1 is that the elastic body in this case comprises two portions 4*a* and 4*b* formed in one piece and having a substantially tubular shape as well as different diameters. The portion 4*a*, which has the largest diameter, is adapted to first expand into engagement with the bore hole 3, whereupon the portion 4*b* also expands into engagement with the bore hole. If there is a leakage, involving that the pressure of the injection mass is reduced, the engagement of the portion 4*a* will remain also when the portion 4*b* looses its grip. FIG. 2 also illustrates that the wall of the elastic body 4 may be curved (as seen in longitudinal section) for this very reason.

FIG. 3 shows another alternative embodiment of the invention, which differs from the above embodiments in that the valve means 6 is not a through slit or the like in the end wall, but instead consists of a "bicycle valve". In this embodiment, the first end portion 5 comprises an end wall formed with a through hole, and a hose-like extension piece 9, preferably of the same material as the remainder of the injection means, projecting from the end portion and being radially expandable as well. A rigid tube 10 with a closed end 11 is inserted through the hole in the end wall and introduced into the hose-like extension piece 9, said tube being attached to the end wall by some adhesive, vulcanisation, welding or the like. The tube 10 may also be fixed to the end portion 5 by means of a flange 12 or the like arranged at the tube end, in which case the flange 12 is engaged with the inner surface of the end wall to anchor the tube 10 in the end portion 5. Further, the tube 10 is formed with a radial hole 13 of suitable size, which cooperates with the hose-like extension piece 9 to allow the injection compound to flow into the bore hole 3 when the right injection pressure has been achieved.

FIG. 4 shows yet another embodiment of the injection means, in which a prefabricated valve means 14 is fixed in an opening formed in the end portion in the manner described above. The valve means illustrated in FIG. 4 is a ball valve, but also other types of prefabricated valve means can be used.

The injection compound is supplied under pressure to the inventive injection means via the duct 6, and is injected into the bore hole 3 and the cracks 2 as above. Then, the injection compound is allowed to set and harden under pressure, whereupon the second end portion 7 and the associated feeding pipe 8 are cut off along the adjacent wall portion of the concrete structure 1 or the like, the remainder of the injection means being left in the bore hole 3. When several cracks are to be sealed, several holes are drilled, each hole being equipped with an injection means as above and connected to a common pressure fluid source for the injection compound which is supplied to all the injection means at the same time. Thus, the invention enables a more rational injection process than has previously been possible with the use of prior art injection means.

It goes without saying that the invention is by no means restricted to the embodiments described above and shown in the drawings, and can be modified in many ways within the scope of the appended claims.

I claim:

1. A device for injecting a material, such as concrete and plastic, in a flowable state into cracks in a concrete structure, a rock face, and the like, said device comprising a substantially tubular, integral, elastic body adapted to be secured within a bore hole in communication with the cracks, said body having an inlet end portion adapted to be connected to a feed pipe for the material to be injected, an outlet end portion having non-return valve means associated therewith which opens at a predetermined pressure, and a radially expandable intermediate portion joining said inlet end portion and said outlet end portion, said intermediate portion defining an internal flow path from said inlet end portion to said outlet end portion such that fluid flowing from said inlet end portion to said outlet end portion flows in contact with an inner wall of said intermediate portion, said intermediate portion being constructed to expand under pressure of said material and thereby secure said body within the bore hole before said non-return valve means opens to inject said material into the bore hole.

2. A device according to claim 1, wherein said intermediate portion is of substantially constant diameter over its entire length.

3. A device according to claim 1, wherein said intermediate portion includes at least two lengthwise portions of different diameter.

4. A device according to claim 3, wherein one of said lengthwise portions is adapted to expand before the other.

5. A device according to claim 1, wherein said body is constituted by a single piece of elastic material.

6. A device according to claim 1, wherein said non-return valve means includes one of a through slit, a cross-slot and a hole formed in an end wall of said outlet end portion of said body.

7. A device according to claim 1, wherein said non-return valve means includes a pre-fabricated valve element mounted to said outlet end portion of said body.

8. A device according to claim 1, including means fixing said inlet end portion to the feed pipe.

9. A device according to claim 8, wherein said means includes one of adhesive and vulcanization.

* * * * *